US010175590B2

(12) United States Patent
Ike et al.

(10) Patent No.: US 10,175,590 B2
(45) **Date of Patent: *Jan. 8, 2019**

(54) ELECTROPHOTOGRAPHIC PHOTOSENSITIVE BODY AND IMAGE FORMING APPARATUS PROVIDED WITH SAME

(71) Applicant: KYOCERA Document Solutions Inc., Osaka (JP)

(72) Inventors: Maki Ike, Osaka (JP); Ai Takagami, Osaka (JP); Masaki Kadota, Osaka (JP); Takahiko Murata, Osaka (JP); Hisashi Mukataka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 232 days.

This patent is subject to a terminal disclaimer.

(21) Appl. No.: 15/128,801

(22) PCT Filed: Dec. 7, 2015

(86) PCT No.: PCT/JP2015/084240

§ 371 (c)(1),
(2) Date: Sep. 23, 2016

(87) PCT Pub. No.: WO2016/121231

PCT Pub. Date: Aug. 4, 2016

(65) Prior Publication Data

US 2018/0217512 A1 Aug. 2, 2018

(30) Foreign Application Priority Data

Jan. 30, 2015 (JP) ..... 2015-017235
Nov. 4, 2015 (JP) ..... 2015-216765

(51) Int. Cl.
*G03G 5/00* (2006.01)
*G03G 5/08* (2006.01)
(Continued)

(52) U.S. Cl.
CPC ..... *G03G 5/08* (2013.01); *G03G 5/047* (2013.01); *G03G 5/102* (2013.01); *G03G 5/147* (2013.01); *G03G 2215/00957* (2013.01)

(58) Field of Classification Search
CPC ..... G03G 5/08; G03G 5/102
(Continued)

(56) References Cited

U.S. PATENT DOCUMENTS 9,507,287 B2 * 11/2016 Takagami ..... G03G 15/0266
2002/0001482 A1 1/2002 Iinuma ..... 399/159
(Continued)

FOREIGN PATENT DOCUMENTS

JP H 11-143099 A 5/1999
JP 2001-337470 A 12/2001
(Continued)

OTHER PUBLICATIONS

Japanese Office Action dated Sep. 5, 2017, issued by the Japanese Patent Office in corresponding application JP 2016-571795.

*Primary Examiner* — Mark A Chapman
(74) *Attorney, Agent, or Firm* — Stein IP, LLC

(57) ABSTRACT

This electrophotographic photosensitive body (20) comprises a supporting body (20*a*) and a photosensitive layer (20*b*) that is formed on the surface of the supporting body (20*a*). The surface of the photosensitive layer (20*b*) has an arithmetic mean roughness Ra within the range of from 20 nm to 100 nm (inclusive), a ten-point average roughness Rz within the range of from 0.2 μm to 1.0 μm (inclusive) and a mean spacing of profile irregularities Sm of 20 μm or less in the initial stage of use.

7 Claims, 11 Drawing Sheets

(51) Int. Cl.
*G03G 5/047* (2006.01)
*G03G 5/147* (2006.01)
*G03G 5/10* (2006.01)

(58) Field of Classification Search
USPC ..... 430/56
See application file for complete search history.

(56) References Cited

U.S. PATENT DOCUMENTS

| | | | | |
|---|---|---|---|---|
| 2011/0129770 | A1 | 6/2011 | Aoki et al. | 430/66 |
| 2016/0238961 | A1* | 8/2016 | Takagami | G03G 15/0266 |

FOREIGN PATENT DOCUMENTS

| | | | |
|---|---|---|---|
| JP | 2006-201686 | A | 8/2006 |
| JP | 2008-216306 | A | 9/2008 |
| JP | 2011-133865 | A | 7/2011 |
| JP | 2013-117624 | A | 6/2013 |

* cited by examiner

ELECTROPHOTOGRAPHIC PHOTOSENSITIVE BODY AND IMAGE FORMING APPARATUS PROVIDED WITH SAME

CROSS-REFERENCE TO RELATED APPLICATIONS

This application is a national stage of International Application No. PCT/JP2015/084240, filed Dec. 7, 2015, which claims the benefit of priority to Japanese Application No. 2015-017235, filed Jan. 30, 2015, and Japanese Application No. 2015-216765, filed Nov. 4, 2015, in the Japanese Patent Office, the disclosures of which are incorporated herein in their entireties by reference.

TECHNICAL FIELD

The present invention relates to an electrophotographic photosensitive body on the surface of which a toner image is formed, and also relates to an image forming apparatus provided with such an electrophotographic photosensitive body.

BACKGROUND ART

As image forming apparatuses such as printers, copiers, facsimile machines, multifunction peripherals provided with their functions, etc., there are known those that are provided with a photosensitive drum as one example of an electrophotographic photosensitive body, a charging device which electrostatically charges the surface of the photosensitive drum, and a cleaning blade which is arranged in contact with the surface of the photosensitive drum and which removes the toner and additive that remain on the surface of the photosensitive drum.

The photosensitive drum is composed of, for example, a drum pipe made of metal which serves as a support body and a photosensitive layer which is formed on the surface of the drum pipe. As photosensitive drums, there are proposed, for example, those that use amorphous silicon for the photosensitive layer and that has the surface of the drum pipe coarsened (e.g., Patent Documents 1 and 2).

In the photosensitive drum described in Patent Document 1, a plurality of spherical vestigial dents are formed on the surface of the drum pipe such that, over a reference length of 2.5 mm on the surface of the photosensitive drum, the ten-point average roughness Rz is in the range of 0.72 [μm] or more but 1.25 [μm] or less. In this way, adhesion of toner at the time of remaining toner cleaning is suppressed, and the scar resistance of the surface of the photosensitive drum is improved.

On the other hand, in the photosensitive drum of Patent Document 2, linear grooves in a triangular shape are formed on the surface of the photosensitive drum in the circumferential direction so that the surface condition of the photosensitive drum is such that the center-line arithmetic average roughness Ra is in the range of 0.08 [μm] to 0.12 [μm] and the ten-point average roughness Rz is in the range of 0.45 [μm] to 0.75 [μm]. In this way, the rotation torque of the photosensitive drum is reduced.

LIST OF CITATIONS

Patent Literature

Patent Document 1: Japanese Patent Application Published as No. H11-143099

Patent Document 2: Japanese Patent Application Published as No. 2001-337470

SUMMARY OF THE INVENTION

Technical Problem

With the configuration described in Patent Document 1, the surface irregularities on the surface of the drum pipe are so large that toner additive or the like scrapes through the gaps between the cleaning blade and the surface of the photosensitive drum. In particular, in a case where the charging device is arranged close, the cleaning by the charging device may fall behind, rather causing contamination of the charging device.

On the other hand, with the configuration described in Patent Document 2, on the surface of the photosensitive drum, there are surface irregularities in the axial direction but not in the circumferential direction, and thus fine convexities on the side faces of the hills and valleys eventually wear and flatten. The edge of the cleaning blade, in minute regions in which it makes contact with a flat surface, is dragged in the rotation direction (circumferential direction) of the photosensitive drum, and stick-slip, though slight, occurs. At this time, additive scrapes through the grooves running in the circumferential direction, and thus the charging device is contaminated.

With consideration given to the problems mentioned above, an object of the present invention is to provide an electrophotographic photosensitive body that can suppress image defects for a long period, and to provide an image forming apparatus provided with such an electrophotographic photosensitive body.

Means for Solving the Problem

To achieve the above object, according to a first configuration of the present invention, an electrophotographic photosensitive body includes a support body and a photosensitive layer formed on the surface of the support body. In this electrophotographic photosensitive body, at the initial stage of use, the surface of the photosensitive layer has an arithmetic average roughness Ra in the range of 20 nm or more but 100 nm or less, a ten-point average roughness Rz in the range of 0.2 μm or more but 1.0 μm or less, and an average peak-valley interval Sm of 20 μm or less.

In the present description, "arithmetic average roughness Ra", "ten-point average roughness Rz", and "average interval Sm" are based on the surface roughness defined in the 1994 edition of JIS B0601.

Advantageous Effects of the Invention

According to the first configuration of the present invention, an electrophotographic photosensitive body has a satisfactory surface condition that prevents toner additive or the like from scraping through the gap with a cleaning blade and that prevents the rotation torque from rising due to contact with the cleaning blade, and thus occurrence of image defects can be suppressed for a long period.

DESCRIPTION OF EMBODIMENTS

Figure 1:
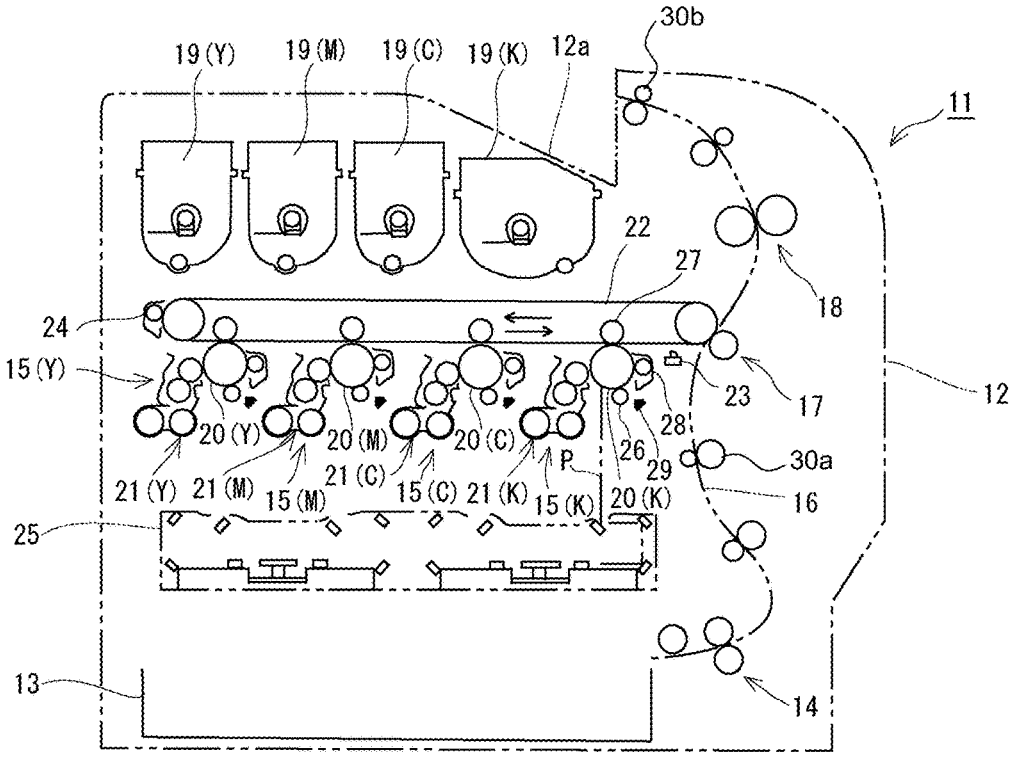
FIG. 1 is a schematic sectional view showing an outline configuration of an image forming apparatus 11 incorporating a photosensitive drum 20 according to the present invention.
Figure 2:
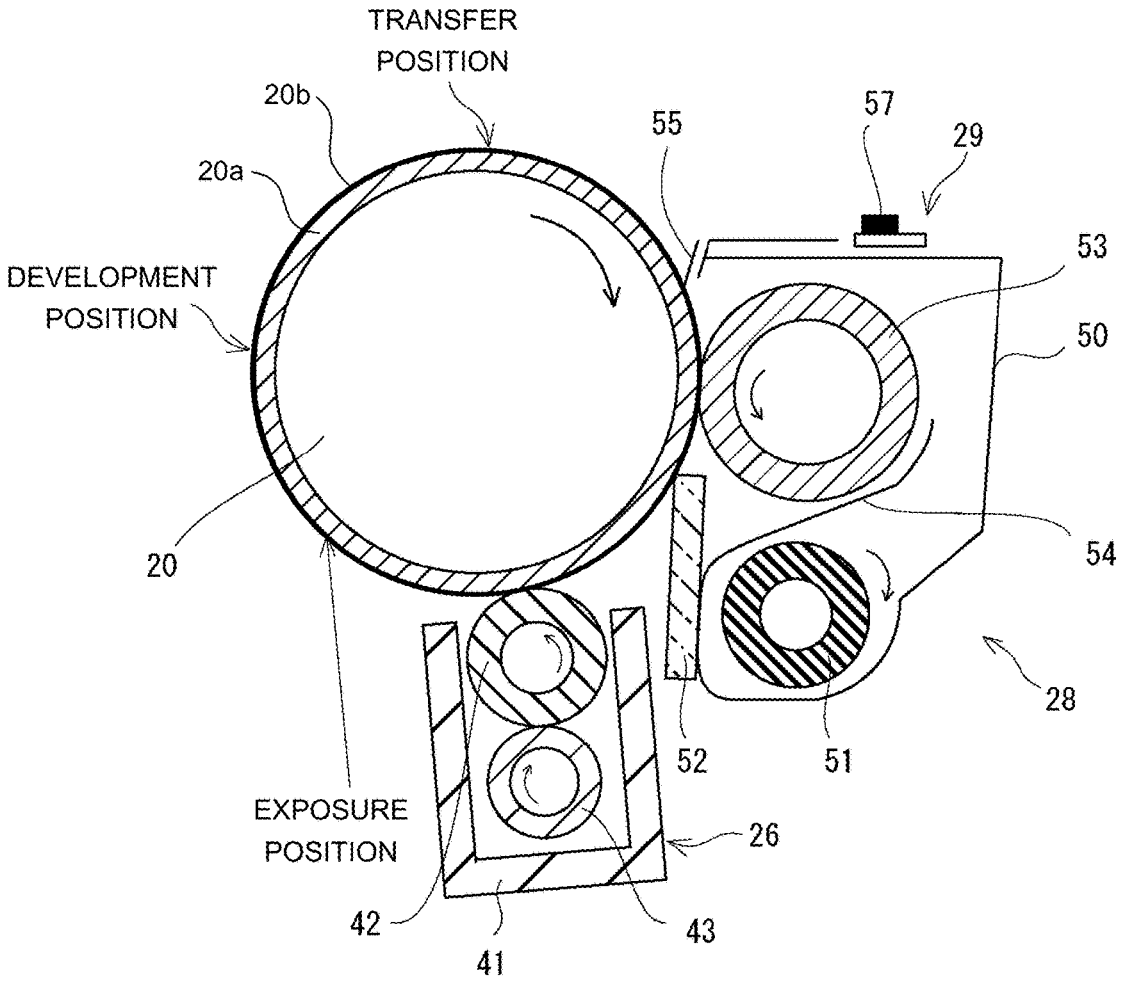
FIG. 2 is an outline diagram showing a configuration around the photosensitive drum 20 in the image forming apparatus 11.

Hereinafter, embodiments of the present invention will be described with reference to the accompanying drawings. FIG. 1 is a schematic sectional view showing an outline configuration of an image forming apparatus 11 incorporating a photosensitive drum 20 according to the present invention. FIG. 2 is an outline diagram showing a configuration around the photosensitive drum 20 in the image forming apparatus 11 shown in FIG. 1.

1. Configuration of Image Forming Apparatus 11

(Overall Configuration)

As shown in FIG. 1, the image forming apparatus 11 according to the embodiment is a tandem-type color printer. The image forming apparatus 11 includes, inside a printer main body 12, a sheet feed cassette 13 which stores recording sheets (unillustrated), a sheet feeding unit 14 which feeds one recording sheet after another from the sheet feed cassette 13, an image formation processing unit 15 which performs image formation processing on a recording sheet fed from the sheet feed cassette 13 or from a manual feed tray (unillustrated), a recording sheet transport passage 16 which transports the recording sheet fed from the sheet feed cassette 13 or from the manual feed tray, a secondary transfer unit 17 which transfers a toner image formed in the image formation processing unit 15 to the recording sheet transported along the recording sheet transport passage 16, and a fixing unit 18 which fixes the toner image transferred in the secondary transfer unit 17 to the recording sheet.

(Configuration of Image Formation Processing Unit 15)

The image formation processing unit 15 adopts a tandem system which performs image formation processing by using toner (developer) of four colors, namely, for example, yellow (Y), magenta (M), cyan (C), and black (K). In the following description, wherever a particular color needs to be specified, a reference numeral will be suffixed with a color designation (Y, M, C, or K) in parentheses; for common description, a reference numeral alone will be used.

The image formation processing unit 15 includes, to correspond to the different colors (Y, M, C, and K), a plurality of toner containers 19 which store replenishment toner, a plurality of photosensitive drums 20 for forming toner images of the different colors based on print data (image data) transmitted from an externally connected device such as a personal computer, a plurality of developing devices 21 which feed toner to the photosensitive drums 20, an intermediary transfer belt 22 in an endless shape to which the toner images formed on the photosensitive drums 20 are primarily transferred, a belt cleaning device 24 which is arranged upstream of the most upstream-side photosensitive drum 20 in the rotating movement direction of the intermediary transfer belt 22 and which removes remaining toner and the like adhered on the surface of the intermediary transfer belt 22, an exposure unit 25 which emits beam light to the photosensitive drums 20, charging devices 26 which electrostatically charge the surfaces of the photosensitive drums 20 evenly, cleaning devices 28 which remove remaining toner and the like adhered to the surfaces of the photosensitive drums 20, and destaticizing devices 29 which eliminate remaining electric charge on the surfaces of the photosensitive drums 20. The photosensitive drums 20 correspond to one example of an "electrophotographic photosensitive body" in the present invention.

(Configuration of Photosensitive Drum 20)

The photosensitive drum 20 has a photosensitive layer formed on the surface of a support body (base body). Here, as shown in FIG. 2, the photosensitive drum 20 is composed of a drum pipe 20*a* of metal in the shape of a cylinder and a photosensitive layer 20*b* formed on the surface of the drum pipe. The drum pipe corresponds to one example of a "support body" in the present invention. Examples of the metal of which the drum pipe 20*a* is formed include aluminum, iron, titanium, magnesium, etc. While an organic photosensitive layer employing an organic photoconductor or an inorganic photosensitive layer employing an inorganic photoconductor can be used as the photosensitive layer 20*b*, an amorphous silicon photosensitive layer deposited by deposition or the like of silane gas or the like is preferred for high durability. The photosensitive drums 20 are for carrying toner images of the different colors based on the beam light emitted to their surfaces from the exposure unit 25 and then transferring the toner images to the intermediary transfer belt 22, and are, as shown in FIG. 1, arranged together with the developing devices 21 under the intermediary transfer belt 22. The properties of the photosensitive layer 20*b* of the photosensitive drum 20 will be described later.

As shown in FIGS. 1 and 2, the charging device 26, the exposure unit 25, the developing device 21, the cleaning device 28, and the destaticizing device 29 are arranged around the photosensitive drum 20, and a primary transfer roller 27 is arranged opposite the photosensitive drum 20 across the intermediary transfer belt 22.

The toner images transferred to the intermediary transfer belt 22 in primary transfer sections each composed of the photosensitive drum 20 and the primary transfer roller 27 cooperating together are, in the secondary transfer unit 17, transferred to the recording sheet that has been transported through the recording sheet transport passage 16 from the sheet feed cassette 13 or from the manual feed tray.

(Configuration of Developing Device 21)

The developing devices 21 of basically the same configuration are arranged side by side under the intermediary transfer belt 22, along its rotating movement direction. The developing devices 21 develop electrostatic latent images formed on the surfaces of the photosensitive drums 20 into toner images by adhering toner containing toner additive (abrasive particles) comprising particles of metal such as titanium oxide. As the developing devices 21, conventionally known ones can be used.

(Configuration of Intermediary Transfer Belt 22)

The intermediary transfer belt 22 is an endless belt extended in the horizontal direction between a driving roller and a following roller inside the printer main body 12, and is driven to circulate during image forming operation as the driving roller is rotated by a belt driving motor (unillustrated).

(Configuration of Toner Concentration Sensor 23)

A toner concentration sensor 23 measures the reflected density of the toner image on the intermediary transfer belt 22, and outputs the detected value to a control unit (unillustrated). The toner concentration sensor 23 may be provided at a plurality of places along each of the rotating movement direction of the intermediary transfer belt 22 and the width direction perpendicular to the rotating movement direction. Here, arranging the toner concentration sensor 23 such that it detects toner density only on one side in the width direction of the intermediary transfer belt 22 makes it impossible to cope with, for example, a phenomenon in which density differs between opposite end parts in the width direction of the intermediary transfer belt 22 (a phenomenon of laterally uneven density), if such a phenomenon occurs. Thus, it is preferable that the toner concentration sensor 23 be arranged near opposite ends in the width direction.

(Configuration of Charging Device 26)

As shown in FIG. 2, the charging device 26 has, inside a charger housing 41, a charging roller 42 which makes contact with the photosensitive drum 20 and applies a charging bias to the drum surface and a charger cleaning roller 43 which cleans the charging roller 42.

The charging roller 42 is formed of, for example, electrically conductive rubber, and is arranged in contact with the photosensitive drum 20. As shown in FIG. 2, as the photosensitive drum 20 rotates in the clockwise direction, the charging roller 42 in contact with the surface of the photosensitive drum 20 follows it to rotate in the counterclockwise direction. At this time, a predetermined voltage is applied to the charging roller 42 so that the surface of the photosensitive drum 20 is electrostatically charged evenly.

Moreover, as shown in FIG. 2, as the charging roller 42 rotates, the charger cleaning roller 43 in contact with the charging roller 42 follows it to rotate in the clockwise direction so as to remove foreign matter adhered to the surface of the charging roller 42.

(Configuration of Cleaning Device 28)

The cleaning device 28 includes a cleaning housing 50 which has a depth in the recording sheet width direction (the direction perpendicular to the recording sheet transport direction), a collecting spiral 51 which is arranged in a lower part of the cleaning housing 50 inside it and which rotates in the clockwise direction in FIG. 2 and thereby transports collected toner to one side in the recording sheet width direction to discharge it into a waste toner container (unillustrated), a cleaning blade 52 which is fitted to a lower part of the cleaning housing 50 outside it, a rubbing roller (cleaning roller) 53 which is arranged in an upper part of the cleaning housing 50 inside it and which makes contact with the surface of the photosensitive drum 20, and a toner feed guide plate 54 which is arranged inside the cleaning housing 50 between the collecting spiral 51 and the rubbing roller 53. To prevent collected toner from leaking out of the cleaning housing 50, a cleaning seal 55 is provided at the upstream end of the cleaning housing 50.

The cleaning blade 52 is formed of urethane rubber or the like. The cleaning blade 52 is arranged such that its tip end makes contact with the surface of the photosensitive drum 20 from below the rotary shaft of the photosensitive drum 20. Here, the tip end of the cleaning blade 52 makes contact in the counter direction with respect to the rotation direction of the photosensitive drum 20 (see the arrow in FIG. 2).

The rubbing roller 53 collects waste toner from the surface of the photosensitive drum 20, and also rubs the surface of the photosensitive drum 20 with the waste toner that has adhered to the surface of the rubbing roller 53. Accordingly, to maintain a high waste toner retention capability, the rubbing roller 53 is formed of foamed rubber (e.g., carbon-containing electrically conductive foamed EPDM) in a cylindrical shape extending in the recording sheet width direction, and is arranged upstream of the tip end of the cleaning blade 52 in the rotation direction of the photosensitive drum 20. The rotation direction of the rubbing roller 53 is opposite to the rotation direction of the photosensitive drum 20.

The toner feed guide plate 45 partitions between the side where the rubbing roller 53 is located and the side where the collecting spiral 51 is located, and guides the waste toner collected by the rubbing roller 53 to the collecting spiral 51.

(Configuration of Destaticizing Device 29)

The destaticizing device 29 is arranged downstream of the primary transfer roller 27 along the rotation direction of the photosensitive drum 20. In the destaticizing device 29, as shown in FIG. 2, an LED (light-emitting diode) 57 is used, and a reflector plate is provided as necessary. The destaticizing device 29 is fitted to the top face of the cleaning housing 50 of the cleaning device 28. The destaticizing device 29 shines destaticizing light to the photosensitive drum 20 and thereby eliminates the electrostatic charge on its surface in preparation for the electrostatic charging process in the image formation next time.

2. Image Forming Procedure

Next, an image forming procedure in an image forming apparatus 100 will be described. When image data is input from an externally connected device such as a personal computer, first, the surfaces of the photosensitive drums 20 are electrostatically charged evenly by the charging devices 26, and then beam light is shone to the surfaces of the photosensitive drums 20 by the exposure unit 25 so that electrostatic latent images based on the image data are formed on the photosensitive drums 20. The developing devices 21 are charged with predetermined amounts of two-component developer (hereinafter also referred to simply as developer) of different colors, namely yellow, magenta, cyan, and black respectively. The developing devices 21 are replenished with toner from the toner containers 19 when the proportion of toner in the two-component developer charged in the developing devices 21 falls below a prescribed value as toner images are formed as will be described later. The toner in the developer is fed onto the photosensitive drums 20 by the developing devices 21, and electrostatically adheres to them, and thereby toner images based on the electrostatic latent images formed by exposure to light from the exposure unit 25 are formed.

On the other hand, in coordination with the timing with which the toner images are formed in the image formation processing unit 15, a recording sheet is fed out of the sheet feed cassette 13 (or the manual feed tray), passes through the recording sheet transport passage 16, and is transported to a registration roller pair 30*a*.

Then, an electric field is applied at a predetermined transfer voltage between the primary transfer rollers 27 and the photosensitive drums 20 by the primary transfer rollers 27, and thereby the yellow, magenta, cyan, and black toner images on the photosensitive drums 20 are primarily transferred to the intermediary transfer belt 22. These images of four colors are formed with a positional relationship previously determined for the formation of a predetermined full-color image. Then, in preparation for the subsequent formation of new electrostatic latent images, the toner and the like that remains on the surfaces of the photosensitive drums 20 after primary transfer is removed by the cleaning devices 28. Also, the electric charge remaining on the surfaces of the photosensitive drums 20 is eliminated by the destaticizing devices 29.

When the intermediary transfer belt 22 starts to rotate in the clockwise direction, the recording sheet is transferred from the registration roller pair 30*a* to the secondary transfer unit 17, which is provided to adjoin the intermediary transfer belt 22, with predetermined timing, and the full-color image on the intermediary transfer belt 22 is secondarily transferred to the recording sheet. The recording sheet having the toner image transferred to it is transported to the fixing unit 18. The remaining toner and the like adhered to the surface of the intermediary transfer belt 22 are removed by the belt cleaning device 24.

The recording sheet transported to the fixing unit 18 is heated and pressed so that the toner image is fixed to the surface of the recording sheet, and thereby the predetermined full-color image is formed. The recording sheet having the full-color image formed on it is guided to the terminal end part of the recording sheet transport passage 16, and is discharged onto a discharge tray 12*a*, which serves also as the top face of the printer main body 12, by a discharge roller pair 30*b*.

3. Properties of Photosensitive Layer of Photosensitive Drum 20

<1st Embodiment>

A description will now be given of the properties of a photosensitive layer 20*b* that constitutes a characteristic part of a photosensitive drum 20 according to a first embodiment. The photosensitive drum 20 of this embodiment has such a surface roughness that, at the initial stage of use, the surface of the photosensitive layer 20*b* has an arithmetic average roughness Ra in the range of 20 [nm] or more but 80 [nm] or less, a ten-point average roughness Rz in the range of 0.2 [μm] or more but 0.9 [μm] or less, and an average peak-valley interval Sm of 20 [μm] or less. The photosensitive drum 20 has to have this surface condition at least at the initial stage of its use (in a state at the start of its use, in other words, in a state after factory shipment). The arithmetic average roughness Ra, the ten-point average roughness Rz, and the average interval Sm are measured by a surface roughness measurement method defined in the 1994 edition of JIS B0601, by using a stylus-type two-dimensional roughness tester.

(1) Arithmetic Average Roughness Ra

The arithmetic average roughness Ra of the surface of the photosensitive layer 20*b* at the initial stage of use has to be in the range of 20 [nm] or more but 100 [nm] or less. When the arithmetic average roughness Ra is less than 20 [nm], the cleaning blade 52 wears during use for a long time, increasing the amount of additive that scrapes through, which leads to an image defect. When the arithmetic average roughness Ra is more than 100 [nm], the gap between the cleaning blade 52 and the surface of the photosensitive layer 20*b* is large. Thus, at a comparatively early stage of durability printing, additive starts to scrape through, and as a result the charging device 26 starts to be contaminated, leading to an image defect due to uneven electrostatic charging of the surface of the photosensitive drum 20.

Figure 3:
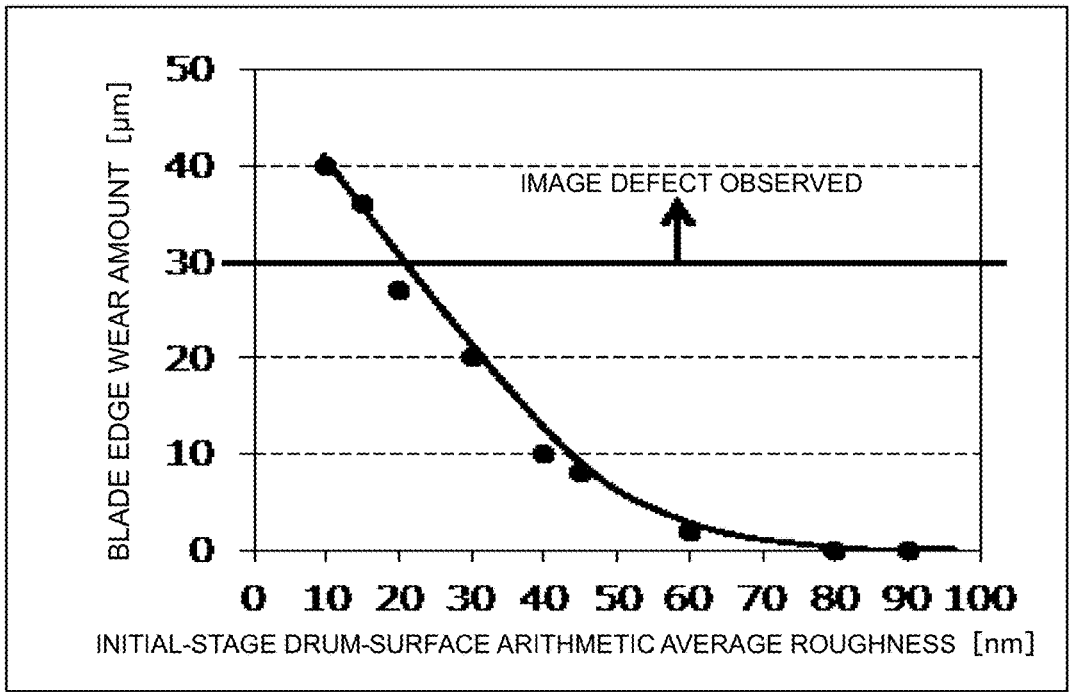
FIG. 3 is a graph showing a relationship between the amount of wear of an edge part of a cleaning blade 52 after durability printing of 300000 sheets and the arithmetic average Ra of the photosensitive drum 20 at an initial stage.

FIG. 3 is a graph showing a relationship between the amount of wear of the edge of the cleaning blade 52 after durability printing of 300000 sheets and the arithmetic average roughness Ra of the surface of the photosensitive layer 20*b* at the initial stage of use of the photosensitive drum 20. As shown in FIG. 3, when the arithmetic average roughness Ra of the surface of the photosensitive layer 20*b* at the initial stage of use of the photosensitive drum is less than 20 [nm], the amount of wear of the edge of the cleaning blade 52 is equal to or more than 30 [μm] or more. When the amount of wear of the edge is equal to or more than 30 [μm], the amount of additive that scrapes through between the cleaning blade 52 and the photosensitive drum 20 increases, with the result that the additive adheres to the surface of the charging roller 42 and increases its resistance value, making it impossible to obtain a satisfactory image.

When the arithmetic average roughness Ra of the surface of the photosensitive layer 20*b* is less than 20 [nm], the friction between the cleaning blade 52 and the photosensitive drum 20 is high, and the cleaning blade 52 wears heavily, resulting in extremely short durability thereafter. That is, it is impossible to obtain a satisfactory image for a long period.

Figure 4:
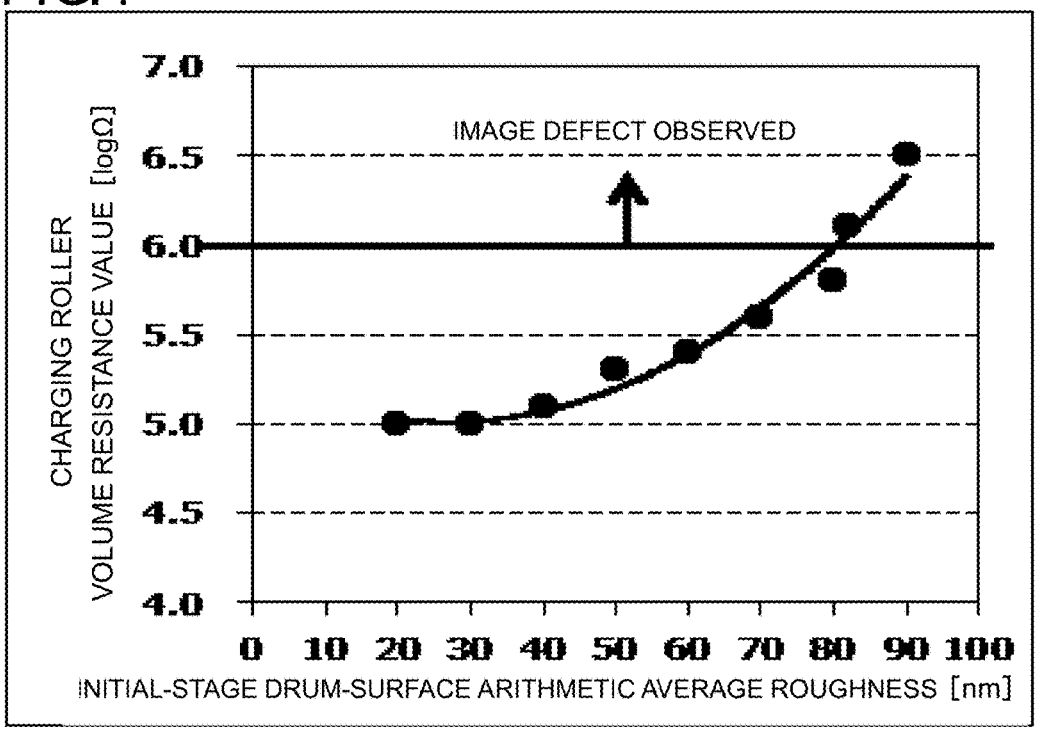
FIG. 4 is a graph showing a relationship between the resistance value of a charging roller 42 after durability printing of 300000 sheets and the arithmetic average Ra of the photosensitive drum 20 at the initial stage.

FIG. 4 is a graph showing a relationship between the resistance value of the charging roller 42 after durability printing of 30000 sheets and the arithmetic average roughness Ra of the surface of the photosensitive layer 20*b* at the initial stage of use of the photosensitive drum 20. As shown in FIG. 4, when the arithmetic average roughness Ra of the surface of the photosensitive layer 20*b* at the initial stage of use of the photosensitive drum 20 is more than 80 [nm], the additive that adheres to the charging roller 42 gives it a resistance value of 6.0 [log Ω] or more. When the resistance value of the charging roller 42 is equal to or more than 6.0 [log Ω], the charging roller 42 is contaminated, making it impossible to obtain a satisfactory image.

As described above, when the arithmetic average roughness Ra of the surface of the photosensitive layer 20*b* at the initial stage of use of the photosensitive drum 20 is more than 80 [nm], the charging roller 42 starts to be contaminated at a comparatively early stage of printing 30000 sheets, making use for a long period difficult. That is, when the surface of the photosensitive drum 20 has large surface irregularities, scraping-through of toner additive occurs at the initial stage. It is preferable that the arithmetic average roughness Ra of the surface of the photosensitive layer 20*b* at the initial stage of use of the photosensitive drum 20 be in the range of 20 [nm] or more but 80 [nm] or less, more preferably in the range of 40 [nm] or more but 60 [nm] or less.

The reason is that, as will be described later in connection with practical examples, when the arithmetic average roughness Ra is in the above-mentioned range, the gap between the cleaning blade 52 and the photosensitive drum 20 can be reduced, and in addition the contact area between the cleaning blade 52 and the photosensitive drum 20 can be suppressed. Accordingly, a low torque can be maintained for a long period, and the wear of the edge of the cleaning blade 52 can be suppressed.

Incidentally, while the durability of the photosensitive drum 20 and how the cleaning blade 52 is durable depends on the additive used, the materials of the photosensitive layer 20*b* and the cleaning blade 52, etc., when the arithmetic average roughness Ra is in the above-mentioned range, it is possible to cope with various additives and the photosensitive layer 20*b* and the cleaning blade 52 of various materials.

(2) Ten-Point Average Roughness Rz

When the arithmetic average roughness Ra of the surface of the photosensitive layer 20*b* in the initial stage of use of the photosensitive drum 20 is in the range of 20 [nm] or more but 100 [nm] or less, it is preferable that the ten-point average roughness Rz of the surface of the photosensitive layer 20*b* at the initial stage of use of the photosensitive drum 20 be in the range of 0.2 [μm] or more but 1.0 [nm] or less.

This is a definition for preventing the following tendency: even when the arithmetic average roughness Ra is in the above-mentioned range, if there are large surface irregularities, whereas the cleaning blade 52 deforms to a certain degree, it cannot follow the surface of the photosensitive drum 20, and the gap formed between the photosensitive drum 20 and the cleaning blade 52 tends to grow large. Incidentally, when the gap between the photosensitive drum 20 and the cleaning blade 52 grows large, scraping-through of additive or the like occurs.

In other words, when there are large convex parts on the surface of the photosensitive drum 20, and the tips of those convex parts make contact with the cleaning blade 52, the concave parts located between the large convex parts do not make contact with the cleaning blade 52, and it is then senseless to define the arithmetic average roughness Ra in a certain range. That is, it is preferable that the surface of the photosensitive drum 20 have no extraordinary surface irregularities but fine surface irregularities, and the conditions for that are defined in terms of ten-point average roughness Rz and arithmetic average roughness Ra. Here, the absence of extraordinary surface irregularities is defined by the ten-point average roughness Rz.

When the arithmetic average roughness Ra of the surface of the photosensitive layer 20*b* at the initial stage of use of the photosensitive drum 20 is in the range of 40 [nm] or more but 60 [nm] or less, it is preferable that the ten-point average roughness Rz of the surface of the photosensitive layer 20*b* at the initial stage of use of the photosensitive drum 20 be in the range of 0.4 [μm] or more but 0.9 [μm] or less. The purpose is to narrow down the range of the ten-point average roughness Rz in accordance with the narrowed range of the arithmetic average roughness Ra.

(3) Average Peak-Valley Interval Sm

When, at the initial stage of use of the photosensitive drum 20, the surface of the photosensitive layer 20*b* has an arithmetic average roughness Ra in the range of 20 [nm] or more but 100 [nm] or less and a ten-point average roughness Rz in the range of 0.2 [μm] or more but 1.0 [μm] or less, it is preferable that the average peak-valley interval Sm be 20 [μm] or less.

The reason is as follows. Even when the arithmetic average roughness Ra and the ten-point average roughness Rz are in the above-mentioned ranges, if there are large convex, parts that are apart from each other, the cleaning blade 52 makes contact with (is supported on) those large convex parts. Here, to determine whether or not the large convex parts are apart from each other, the average peak-valley interval Sm is utilized.

A cleaning blade is elastically deformable, and deforms so as to make contact with the photosensitive drum 20 between large convexities (convex parts). In particular, where the intervals between the convex parts are large, the contact area between the cleaning blade 52 and the photosensitive drum 20 increases. As the contact area increases, due to the friction with the cleaning blade 52, the driving torque of the photosensitive drum 20 increases, the wear of the cleaning blade 52 becomes severe, and eventually the cleaning blade 52 causes stick-slip, resulting in scraping-through of additive and chipping of the edge of the cleaning blade 52. Needless to say, chipping of the edge of the cleaning blade 52 makes it impossible to obtain a satisfactory image.

Moreover, when the average interval Sm is large, convex parts (hills) are large (with broader skirts), and as the peak parts of the convex parts wear during use for a long time, the peak parts come to have flat parts, resulting in an increased contact area with the cleaning blade 52. When, at the initial stage of use of the photosensitive drum, the surface of the photosensitive drum has an arithmetic average roughness Ra of 40 [nm] or more but 60 [nm] or less and a ten-point average roughness Rz of 0.4 [μm] or more but 0.7 [μm] or less, it is preferable that the average interval Sm be 14 [μm] or less. The purpose is to reduce the range of the average interval Sm in accordance with the narrowed ranges of the arithmetic average roughness Ra and the ten-point average roughness Rz.

Figure 5:
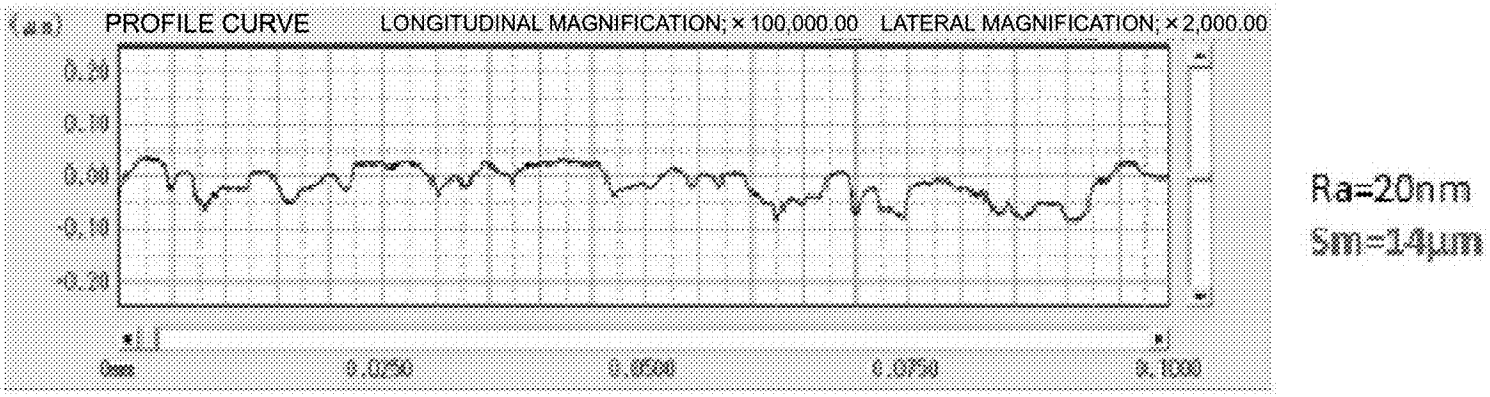
FIG. 5 presents a two-dimensional roughness data waveform on the surface of the photosensitive drum 20 with an arithmetic average Ra of 20 [nm] and an average interval Sm of 14 [μm]
Figure 6:
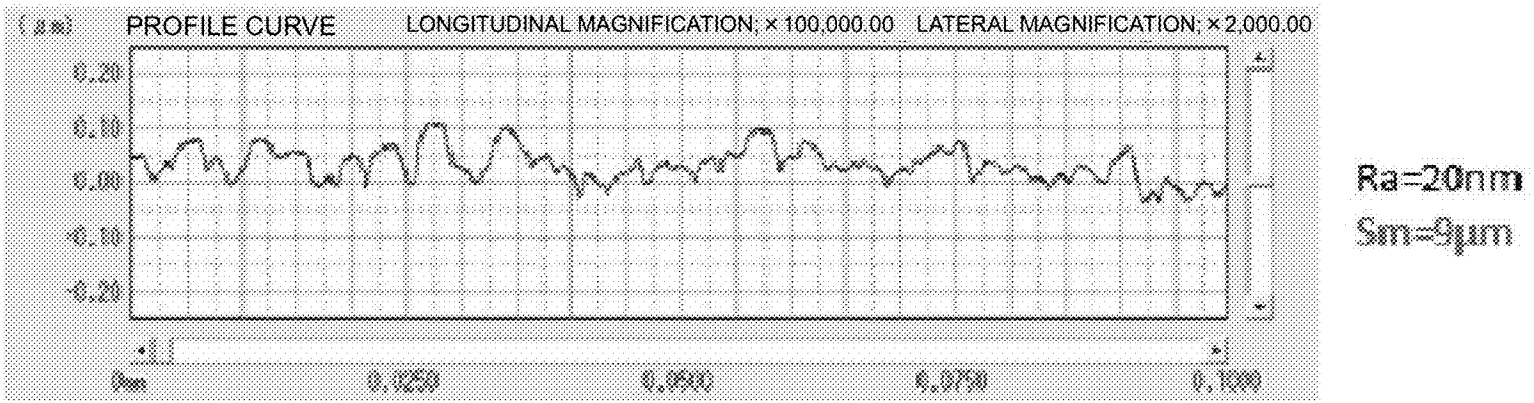
FIG. 6 presents a two-dimensional roughness data waveform on the surface of the photosensitive drum 20 with an arithmetic average Ra of 20 [nm] and an average interval Sm of 9 [μm]

FIGS. 5 and 6 show surface conditions between which the arithmetic average roughness Ra is the same but the average interval Sm differs. FIG. 5 presents a two-dimensional roughness data waveform on the photosensitive layer surface of a photosensitive drum 20 having an arithmetic average roughness Ra of 20 [nm] and an average interval Sm of 14 [μm], and FIG. 6 shows a two-dimensional roughness data waveform on the surface of the photosensitive layer 20*b* of a photosensitive drum 20 having an arithmetic average roughness Ra of 20 [nm] and an average interval Sm of 9 [μm]. For the reasons mentioned above, it is considered that it is preferable that the surface irregularities on the surface of the photosensitive layer 20*b* of the photosensitive drum 20 be such that there are moderate surface irregularities (with an arithmetic average roughness Ra and a ten-point average roughness Rz in predetermined ranges) and that the convex parts have a small pitch (with an average interval Sm equal to or less than a predetermined value).

(4) DUH Hardness

It is preferable that the DUH hardness of the photosensitive layer 20*b* at the initial stage of use of the photosensitive drum 20 be in the range of 500 [kgf/mm$^2$] or more but 1200 [kgf/mm$^2$] or less. When the DUB hardness is less than 500 [kgf/mm$^2$], the photosensitive layer 20*b* of the photosensitive drum 20 tends to wear due to contact with the cleaning blade 52 and the charger cleaning roller 43, and this makes use for a long period impossible. From this viewpoint, it is preferable that the DUH hardness be high. Accordingly, the upper limit of the DUH hardness is defined by the hardness of the photosensitive layer 20*b* with the highest hardness that is currently available. DUH hardness refers to indentation hardness (Martens hardness) as measured on a dynamic ultra-micro hardness tester (in the DUH series, manufactured by Shimadzu Corporation).

(5) Appearance of Surface Irregularities

Figure 12:
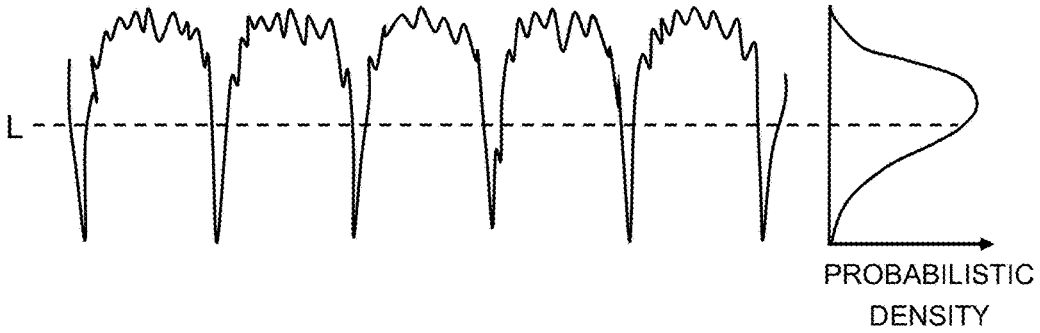
FIG. 12 is a diagram showing surface irregularities with a skewness Rsk less than zero.

It is preferable that, as shown in FIG. 12, which will be described later, the surface irregularities on the surface of the photosensitive layer 20*b* of the photosensitive drum 20 are present irregularly. Here, "irregularly" means that there is no regularity in how surface irregularities are present as seen from one arbitrary direction within a given plane. A case where there are no surface irregularities in a given direction (a case where there are no surface irregularities by design but there actually are fine surface irregularities corresponds to one example of a case where there are no surface irregularities) is irregular.

Figure 7:
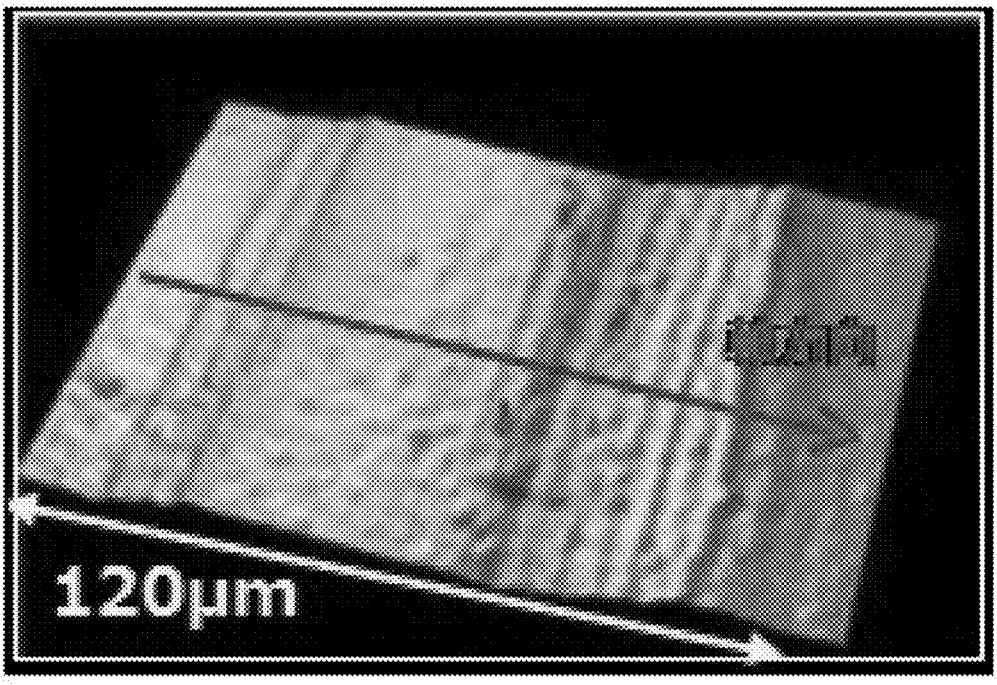
FIG. 7 is an enlarged view of the photosensitive layer surface of the photosensitive drum 20 which has irregular surface irregularities in the axial direction but which has no surface irregularities and has a regular surface condition in the circumferential direction.
Figure 8:
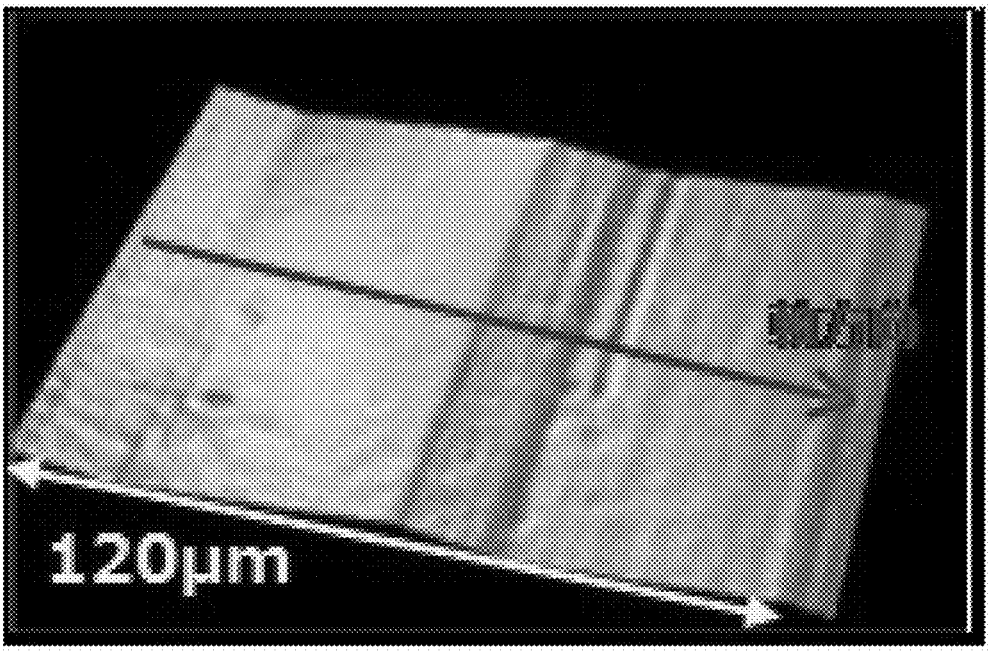
FIG. 8 is an enlarged view of the photosensitive layer surface of the photosensitive drum 20 having the surface condition shown in FIG. 7, after durability printing of 300000 sheets.

FIG. 7 is an enlarged view of the surface of the photosensitive layer 20*b* of the photosensitive drum 20 which has a regular surface condition, and FIG. 8 is an enlarged view of the surface of the photosensitive layer 20*b* of the photosensitive drum 20 having the regular surface condition shown in FIG. 7, after durability printing of 300000 sheets. In FIGS. 7 and 8, the direction parallel to the dimension line marked "120 μm" is the axial direction, and the direction perpendicular to the axial direction is the circumferential direction. In the surface condition shown in FIG. 7, the arithmetic average roughness Ra in the axial direction is 90 [nm].

In FIG. 7, the surface is such that, whereas large surface irregularities are present irregularly in the axial direction, there are no large surface irregularities but only fine surface irregularities in the circumferential direction. Where surface irregularities have regularity in the circumferential direction in this way, additive scrapes through the gap between the cleaning blade 52 and concave parts, and thus contamination of the charging roller 42 through adherence of additive is more likely to occur at the initial stage of use of the photosensitive drum 20.

On the other hand, in the surface condition after durability printing of 300000 sheets, as shown in FIG. 8, whereas large surface irregularities remain in the axial direction, almost no surface irregularities are observed in the circumferential direction (Ra<10 nm). Thus, the edge of the cleaning blade 52 is dragged in the rotation direction of the photosensitive drum 20, and no effect of reducing the driving torque (driving load) of the photosensitive drum 20 is obtained.

Figure 9:
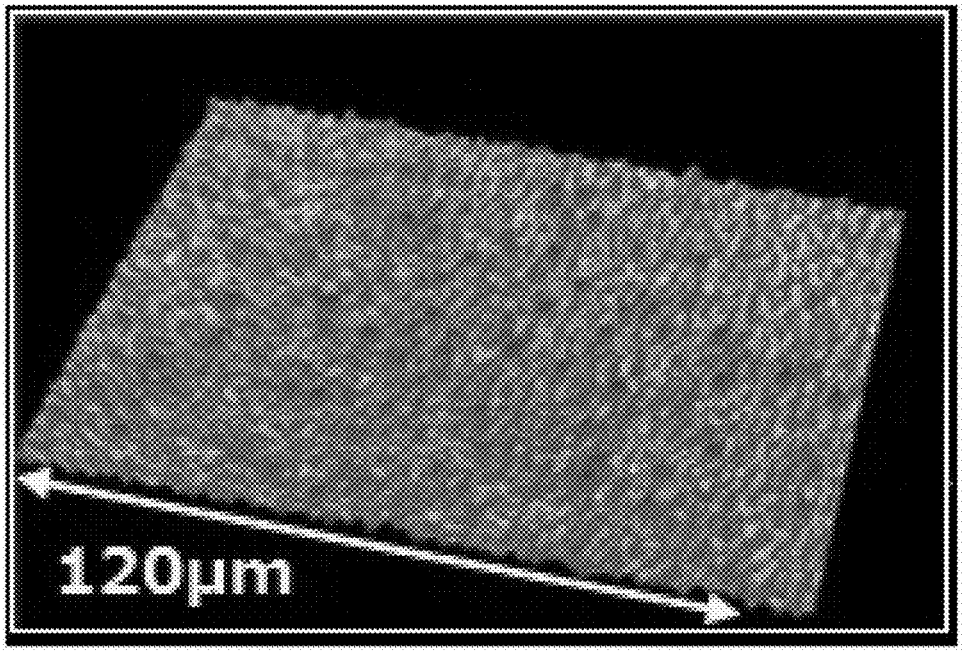
FIG. 9 is an enlarged view of the surface of the photosensitive drum 20 which has irregular surface irregularities the axial and circumferential directions.
Figure 10:
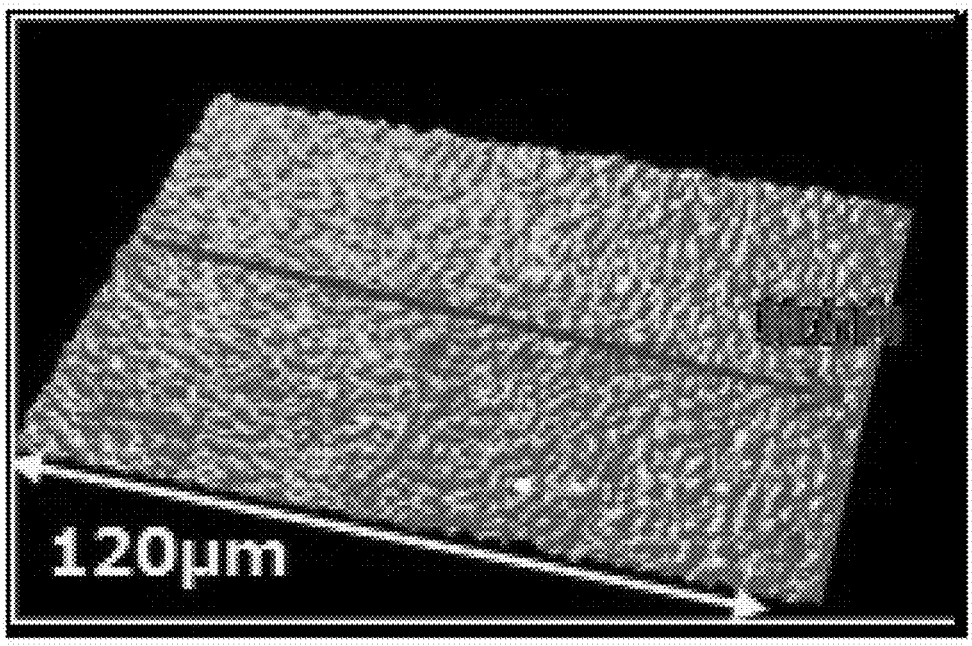
FIG. 10 is an enlarged view showing the surface condition of the photosensitive drum 20 having the surface shown in FIG. 9, after durability printing of 300000 sheets.

FIG. 9 is an enlarged view of the surface of the photosensitive layer 20*b* of the photosensitive drum 20 having an irregular surface condition, and FIG. 10 is an enlarged view of the surface of the photosensitive layer 20*b* of the photosensitive drum 20 having the irregular surface condition shown in FIG. 9, after durability printing of 300000. In FIGS. 9 and 10, the direction parallel to the dimension line marked "120 μm." is the axial direction, and the direction perpendicular to the axial direction is the circumferential direction. In the surface condition shown in FIG. 9, the arithmetic average roughness Ra in the axial direction is 45 [nm].

Where surface irregularities are present irregularly in the axial direction and in the circumferential direction as shown in FIG. 9, the movement of additive on the surface of the photosensitive layer 20*b* of the photosensitive drum 20 is restricted by the surface irregularities, and thus the additive is less likely to scrape through the gap between the cleaning blade 52 and concave parts. Thus, contamination of the charging roller 42 through adhesion of additive is less likely to occur at the initial stage of use of the photosensitive drum 20.

Even in the surface condition after printing 300000 sheets, as shown in FIG. 10, fine surface irregularities (Ra≥10 [nm]) remain in the axial direction and in the circumferential direction. Thus, even after durability printing, scraping-through of additive is suppressed, and contamination of the charging roller 42 through adhesion of additive is less likely to occur. Moreover, the edge of the cleaning blade 52 is not dragged in the rotation direction of the photosensitive drum 20, and an effect of reducing the driving torque (driving load) of the photosensitive drum 20 is obtained. The surface roughness (arithmetic average roughness Ra) of the photosensitive layer 20*b* has to be determined in the range of 20 [nm] or more but 100 [nm] or less with consideration given to durability as the photosensitive drum 20.

(6) Region

It is preferable that the arithmetic average roughness Ra, the ten-point average roughness Rz, and the average interval Sm be in the ranges described above over the entire area of the image formation region on the surface of the photosensitive drum 20.

(7) Toner Additive

As an additive, electrically conductive abrasive fine particles, such as of titanium oxide, silica, or the like, are added to the toner. When the arithmetic average roughness Ra on the surface of the photosensitive layer 20*b* is large, the additive scrapes through the gaps between surface irregularities that the cleaning blade 52 cannot follow. Accordingly, it is preferable that the toner additive used for the photosensitive drum 20 of this embodiment have an average primary particle diameter of 10 nm or more.

<2nd Embodiment>

A description will now be given of the properties of a photosensitive layer 20*b* that constitutes a characteristic part of a photosensitive drum 20 according to a second embodiment. The photosensitive drum 20 of this embodiment has such a surface roughness that, at the initial stage of use, the surface of the photosensitive layer 20*b* has an arithmetic average roughness Ra in the range of 20 [nm] or more but 100 [nm] or less, a ten-point average roughness Rz in the range of 0.2 [μm] or more but 1.0 [μm] or less, and a skewness Rsk of 0.3 or more. The measurement methods for the arithmetic average roughness Ra, the ten-point average roughness Rz, and the average interval Sm are similar to those in the first and second embodiments.

Here, skewness Rsk is one of those parameters which indicate the intensity of surface roughness, represents the degree of symmetry between hill parts and valley parts about the average line (the degree of skewness of surface irregularities), and is expressed, as given by formula (1) below, as the root mean cube of Z(x) over a reference length that is made non-dimensional by the cube of the root-mean-square square-root height Rq.

$$Rsk = \frac{1}{Rq^3}\left(\frac{1}{\ell}\int_0^{\ell} Z^3(x)dx\right) \quad (1)$$

Figure 11:
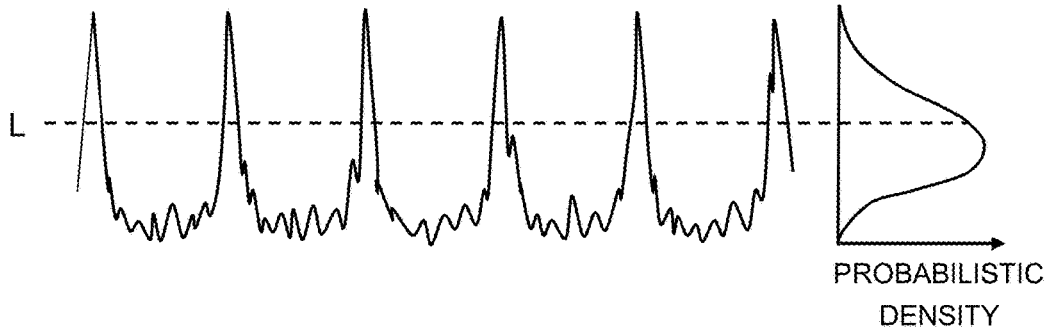
FIG. 11 is a diagram showing surface irregularities with a skewness Rsk more than zero.

When Rsk is larger than zero, as shown in FIG. 11, the surface irregularities are lopsided downward relative to the average line L. On the other hand, when Rsk is smaller than zero, as shown in FIG. 12, the surface irregularities are lopsided upward relative to the average line. That is, when the skewness Rsk of the photosensitive layer 20*b* is larger than zero, the photosensitive layer 20*b* is in a higher degree in point contact with the cleaning blade 52, with a reduced contact area. In this embodiment, fulfilling Rsk≥0.3 helps reduce the contact area between the photosensitive drum 20 and the cleaning blade 52, and helps effectively reduce the friction there.

Moreover, it is preferable that, as in the first embodiment, the DUH hardness of the photosensitive layer 20*b* be set at 500 to 1200 kgf/mm$^2$, and that the pitch of surface irregularities (the average interval Sm) be as small as possible (Sm<20 μm). Furthermore, it is preferable that the toner additive used for the photosensitive drum 20 of this embodiment have an average primary particle diameter of 10 nm or more.

<Third Embodiment>

A description will now be given of the properties of a photosensitive layer 20*b* that constitutes a characteristic part of a photosensitive drum 20 according to a third embodiment. The photosensitive drum 20 of this embodiment has such a surface roughness that, at the initial stage of use, the surface of the photosensitive layer 20*b* has an arithmetic average roughness Ra in the range of 20 [nm] or more but 100 [nm] or less, a ten-point average roughness Rz in the range of 0.2 [μm] or more but 1.0 [μm] or less, and a ratio (Ra [nm]/Sm [μm]) of 3 or more as the ratio of the arithmetic average roughness Ra [nm] to the average peak-valley interval Sm [μm]. The measurement methods for the arithmetic average roughness Ra, the ten-point average roughness Rz, and the average peak-valley interval Sm are similar to those in the first embodiment.

By irregularly forming surface irregularities such that the surface roughness fulfills the ranges mentioned above on the surface of the photosensitive layer 20*b* in the axial direction and the circumferential direction of the photosensitive drum 20, it is possible to reduce the friction between the photosensitive drum 20 and the cleaning blade 52, and to reduce the driving torque of the photosensitive drum 20 and the wear of the edge of the cleaning blade 52. In particular, fulfilling Ra [nm]/Sm [μm]≥3 produces surface irregularities that have a height (depth) three times or more as large as the average interval Sm, and this helps reduce the contact area between photosensitive drum 20 and the cleaning blade 52 and helps effectively reduce friction.

While the surface irregularities formed on the surface of the photosensitive layer 20*b* gradually wear during printing for a long period, by setting the DUH hardness of the photosensitive layer 20*b* at 500 to 1200 kgf/mm$^2$ as in the first and second embodiments, it is possible to maintain the surface irregularities satisfactorily throughout the period of use of the photosensitive drum 20. Thus, the contact area between the photosensitive drum 20 and the cleaning blade 52 does not increase up to the final stage of use of the photosensitive drum 20, it is thus possible to reduce the load that acts on the cleaning blade 52 for a long period, and it is possible to suppress wear and chipping of the edge of the cleaning blade 52 and thereby maintain cleanability on a long-term basis.

The surface irregularities wear starting with convex portions, and thus, with a view to making flat parts as small as possible, it is preferable to set the pitch of surface irregularities (average interval Sm) as small as possible (Sm<20 μm). Moreover, to suppress scraping-through of additive through the gaps between the surface irregularities on the photosensitive layer 20*b* and the cleaning blade 52, it is preferable that the toner additive used for the photosensitive drum 20 of this embodiment have an average primary particle diameter of 10 nm or more.

<Modified Examples>

Although the photosensitive drum 20 and the image forming apparatus 11 according to the present invention have been described above by way of embodiments, the present invention is not limited by those embodiments, but may be implemented as in the modified examples described below. The present invention encompasses any example that is not described in those embodiments and any design change within a range not departing from the spirit of the present invention.

(Modified Example 1)

In the above embodiments, as an example of the image forming apparatus 11, a tandem-type color printer has been described, but application is also possible to, for example, a rotary-type color printer or a monochrome printer. Application is also possible to image forming apparatuses such as copiers, facsimile machines, multifunctional peripherals provided with their functions, etc. The image forming apparatus 11 may have the configuration of the color printer described in connection with the embodiments, or may have any other configuration. However, it is necessary to provide an electrophotographic photosensitive body as described above with the photosensitive drum 20 taken as an example. As a means for cleaning the electrophotographic photosensitive body, it is preferable to provide a cleaning blade 52.

(Modified Example 2)

The photosensitive drum 20 in the embodiments described above use a cylindrical drum pipe 20*a* as a support body, but may instead use a support body of any other shape. Other shapes include shapes like a plate and like an endless belt. Although the photosensitive drum 20 in the embodiments uses amorphous silicon as the photosensitive layer 20*b*, it may instead have a charge injection inhibition layer for inhibiting injection of electric charge from the support body.

(Modified Example 3)

The cleaning device in the embodiments described above has a structure in which the cleaning housing 50, the collecting spiral 51, the cleaning blade 52, the rubbing roller 53, etc. are provided integrally, and it is preferable that it include the cleaning blade 52. Hereinafter, the effects of the present invention will be described in more detail by way of practical examples.

PRACTICAL EXAMPLE 1

(1) Fabricating Photosensitive Drum 20 (Present Invention 1)

A photosensitive drum 20 (Present Invention 1) was fabricated by forming a photosensitive layer 20*b* of amorphous silicon on the surface of a drum pipe 20*a* of aluminum. The drum pipe 20*a* had a diameter of 30 [mm], and had its surface elastically deformed by wet-blast treatment or the like to form fine surface irregularities on the surface. The wet-blast treatment was performed such that the arithmetic average roughness Ra of the surface is in the range of 4 [nm] to 60 [nm].

When the surface roughness of the amorphous silicon photosensitive drum 20 after the deposition of the photosensitive layer 20*b* was measured, the arithmetic average roughness Ra was 45 [nm], the ten-point average roughness Rz was 0.5 [μm], and the average peak-valley interval Sm was 12 [μm].

Moreover, the DUH hardness of the surface of the photosensitive drum 20 was measured by use of a DUH hardness tester (DYNAMIC ULTRA MICRO HARDNESS TESTER DUH-201•202, manufactured by Shimadzu Corporation). The measurement conditions were: inspection depth, 150 nm; load speed, 0.284393 mN/sec; load range, 19.6 mN; holding time 10 sec. The result was that the DUH hardness of the surface was 900 [kgf/mm$^2$].

The surface roughness was measured over a measurement length of 2.5 mm by use of a stylus-type two-dimensional roughness tester (Surfcom 1500DX, manufactured by Tokyo Seimitsu Co., Ltd.). The measurement terminal was of a stylus type with 60-degrees conical diamond, and had a tip radius of 2 [μm]. The measurement length was 2.5 [mm], and the cutoff value was 0.08 [mm]. The filter type was Gaussian, and the inclination correction was least-square linear correction. The cutoff ratio was 300, and the measurement magnification was ×100 k.

Figure 13:
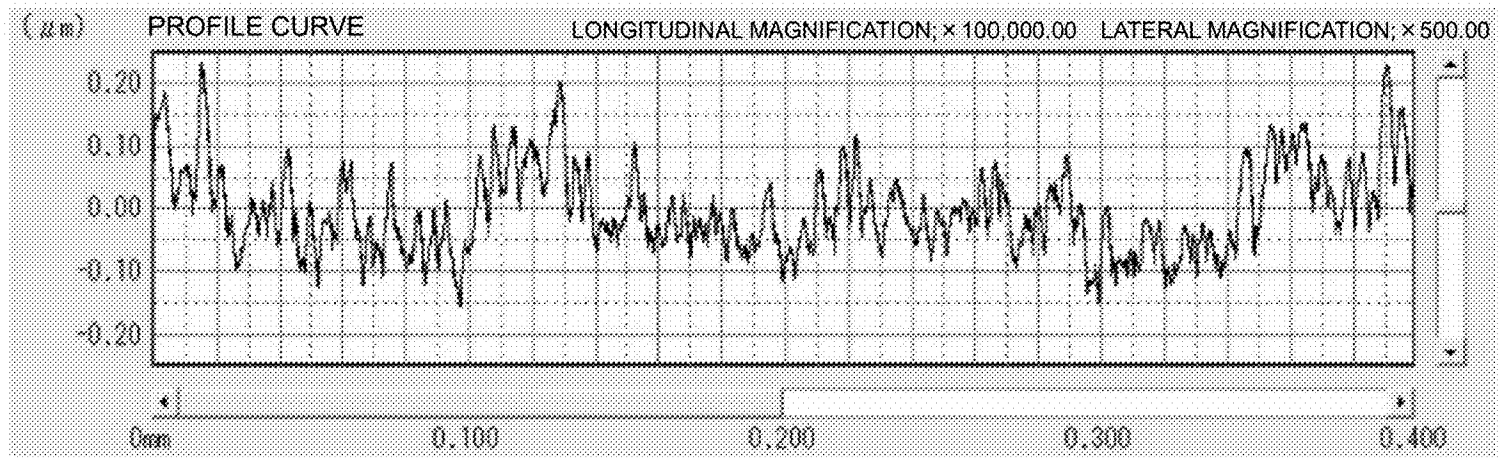
FIG. 13 is a two-dimensional roughness data waveform of the surface condition of the photosensitive drum 20 of Present Invention 1 in Practical Example 1.
Figure 14:
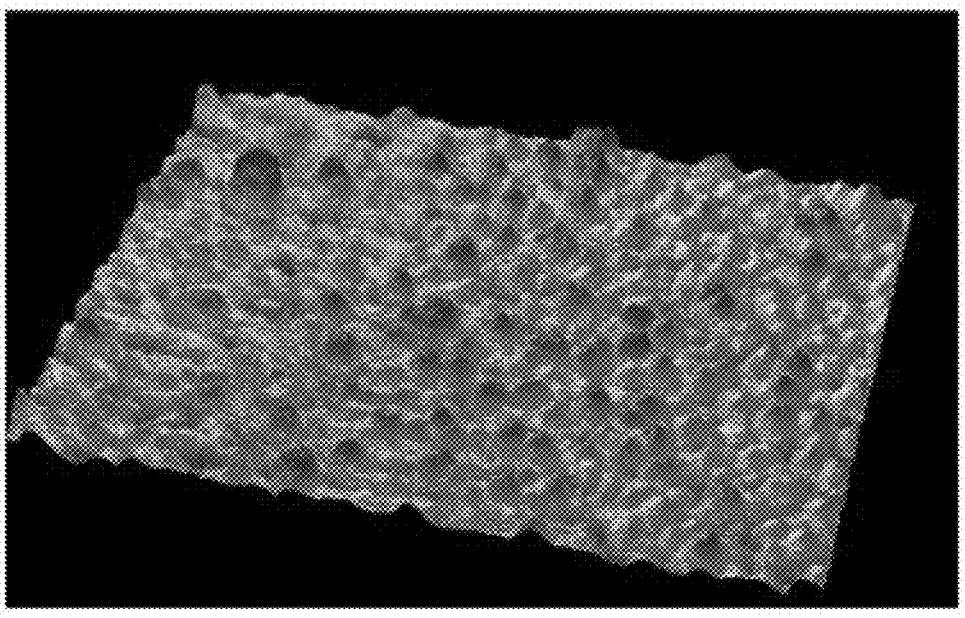
FIG. 14 is a three-dimensional interference microscope data of the surface condition of the photosensitive drum 20 of Present Invention 1 in Practical Example 1.

FIG. 13 presents a two-dimensional roughness data waveform showing the surface condition of the photosensitive drum 20 of Present Invention 1, and FIG. 14 presents a three-dimensional interference microscope data showing the surface condition of the photosensitive drum 20 of Present Invention 1. The data presented in FIG. 13 are the measurement results on the Surfcom 1500DX, and the data presented in FIG. 14 are the measurement results on a three-dimensional interference microscope (WYKONT 1100, manufactured by Veeco).

(2) Fabricating Photosensitive Drum 20 (Comparative Example 1)

A photosensitive drum 20 (Comparative Example 1) was fabricated by forming a photosensitive layer 20*b* of amorphous silicon on the surface of a drum pipe 20*a* of aluminum. The surface of the drum pipe 20*a* was mirror-finished, and when the surface roughness of the photosensitive drum 20 after the deposition of the amorphous-silicon photosensitive layer 20*b* was measured, the arithmetic average roughness Ra was 3 [nm], the ten-point average roughness Rz was 0.1 [μm], and the average peak-valley interval Sm was 8 [μm]. When the DUH hardness of the surface of the photosensitive drum 20 was measured as in Present Invention 1, it was 900 [kgf/mm$^2$].

(3) Comparative Testing

Durability tests were performed by use of the image forming apparatus 11 provided with the photosensitive drums 20 of Present Invention 1 and Comparative Example fabricated as described at (1) and (2) above. The test conditions were: the linear velocity of the photosensitive drum 20 was 267 mm/sec, and, as a test image, a text document with a printing ratio of 5% was printed on 20000 sheets a day, on a total of 600000 sheets. As the cleaning blade 52, a rubber blade made of urethane rubber with a base-to-tip length (free length) of 11.0 mm and a thickness of 2.0 mm was used, and the angle relative to the outer circumferential face of the photosensitive drum 20 was set at 24°, and the amount of overlay was set at 1.2 mm.

(3-1) Torque During Printing

Figure 15:
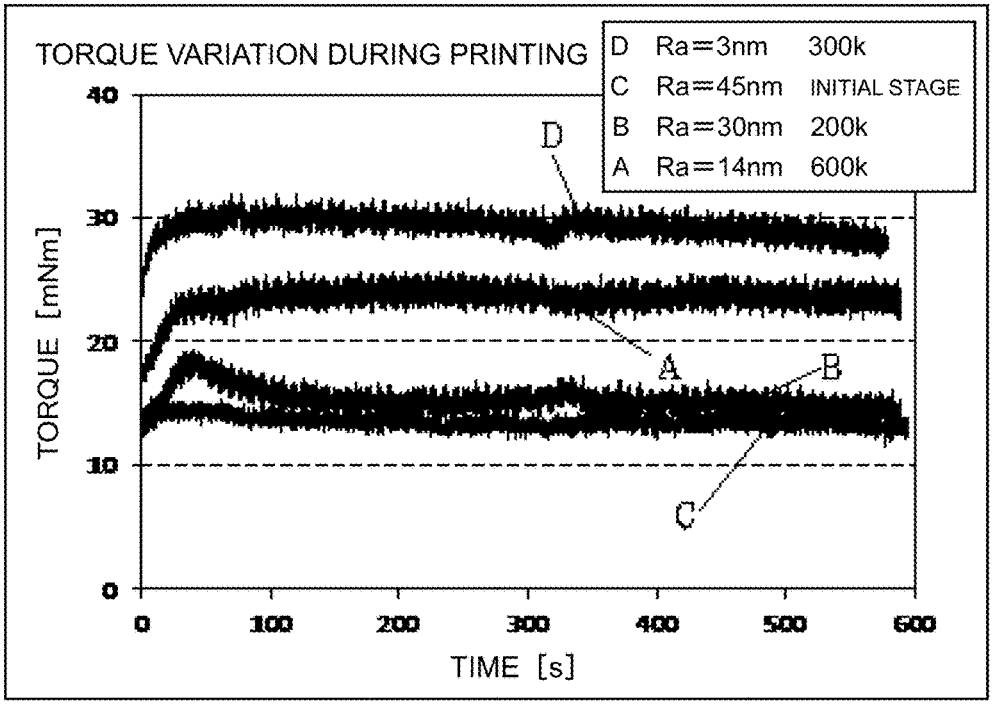
FIG. 15 is a graph showing variation of the driving torque of the photosensitive drum 20 during printing in Practical Example 1.

FIG. 15 is a graph showing variation of the rotation torque of the photosensitive drum 20 during continuous printing using the photosensitive drums 20 of Present Invention 1 and Comparative Example 1. Measurement was performed, for the image forming apparatus 11 provided with the photosensitive drum 20 of Present Invention 1, at an early stage when the number of prints was small ("C" in the graph), when the number of prints reached 200000 (200 k) ("B" in the graph), and when the number of prints reached 600000 (600 k) ("A" in the graph). When the surface roughness of the photosensitive drum 20 was measured on the above three occasions of torque measurement, the arithmetic average roughness Ra after printing 200000 sheets was 30 [nm], and the arithmetic average roughness Ra after printing 600000 sheets was 14 [nm].

To explain the effects of the photosensitive drum 20 of Present Invention 1, also on the image forming apparatus 11 provided with the photosensitive drum 20 of Comparative Example 1, after 300000 sheets were printed, torque measurement was performed during printing, and is shown as "D" is FIG. 15. When the photosensitive drum 20 of Comparative Example 1 was used, the arithmetic average roughness Ra after printing 300000 sheets was 3 [nm].

FIG. 15 reveals that, with the photosensitive drum 20 of Present Invention 1, as the number of prints increases (C<B<A), while the rotation torque of the photosensitive drum 20 during printing increases, the arithmetic average roughness Ra decreases. This is because, as the number of prints increases, convex parts of the photosensitive layer 20*b* on the surface of the photosensitive drum 20 wear and flatten, and simultaneously the contact area with the cleaning blade 52 increases.

Specifically, the arithmetic average roughness Ra (14 nm) after printing 600000 sheets when continuous printing was performed by use of the image forming apparatus 11 provided with the photosensitive drum 20 of Present Invention 1 was larger than the arithmetic average roughness Ra (3 nm) after printing 300000 by use of the photosensitive drum of Comparative Example 1. On the other hand, the rotation torque (about 23 mNm) after printing 600000 by use of the photosensitive drum 20 of Present Invention 1 was smaller than the rotation torque (about 30 mNm) after printing 300000 sheets by use of the photosensitive drum of Comparative Example 1. These results reveal that the photosensitive drum 20 of Present Invention 1, although its surface gradually wears and flattens as the number of prints increases, flattens at lower speed than the photosensitive drum 20 of Comparative Example 1, and excels the photosensitive drum 20 of Comparative Example 1 in durability.

(3-2) Blade Wear

Figure 16:
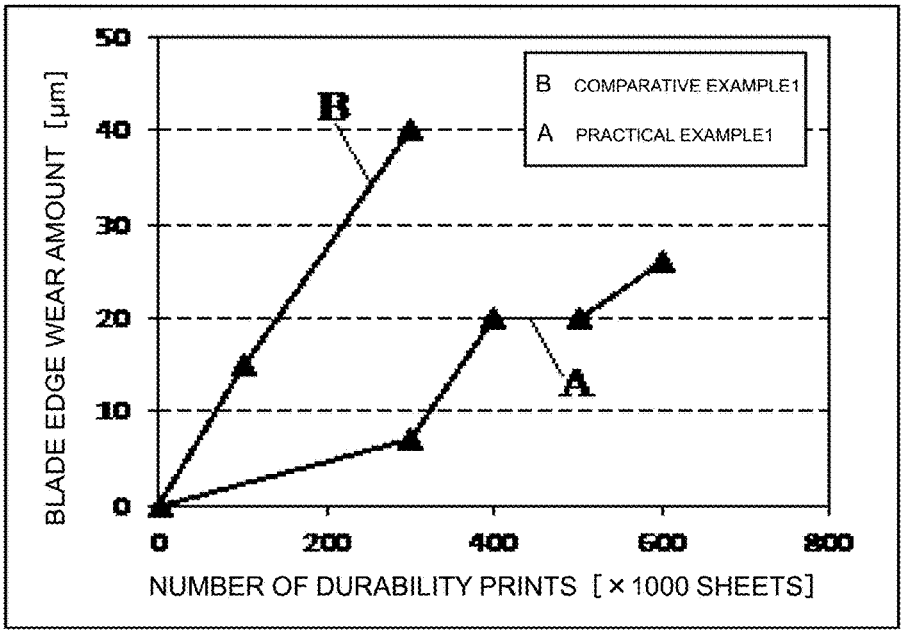
FIG. 16 is a graph showing a relationship between the number of prints and the amount of blade wear in Practical Example 1.

FIG. 16 presents measurement results showing a relationship between the number of prints and the amount of blade wear when continuous printing was performed by use of the image forming apparatus 11 provided with the photosensitive drums 20 of Present Invention 1 and Comparative Example 1. Measurement of the amount of blade wear was performed by repeating a procedure involving measuring it with the cleaning blade 52 removed on completion of printing a predetermined number of sheets and thereafter fitting cleaning blade 52 back. As shown in FIG. 16, the wear of the cleaning blade 52 was smaller when the photosensitive drum 20 of Present Invention 1 ("A" in FIG. 16) was used than when the photosensitive drum 20 of Comparative Example 1 was used ("B" in FIG. 16). These results reveal that the wear of the cleaning blade 52 when the photosensitive drum 20 of Present Invention 1 is used is smaller than when the photosensitive drum 20 of Comparative Example 1 is used, and that the photosensitive drum 20 of Present Invention 1 is preferred also from the viewpoint of the durability of the cleaning blade 52.

PRACTICAL EXAMPLE 2

6 types of photosensitive drums 20 (Present Inventions 2 to 8 and Comparative Examples 2 and 3) with varying arithmetic averages Ra, ten-point averages Rz, average intervals Sm, and ratios Ra/Sm on the surface of the photosensitive layer 20*b* were fabricated, and the relationship among the surface roughness of the photosensitive layer 20*b* at the initial stage of use, the amount of blade wear, and the driving torque of the photosensitive drum 20 was evaluated. The testing method involved mounting the photosensitive drums 20 of Present Inventions 2 to 8 and Comparative Examples 2 and 3 in the image forming apparatus 11, and evaluating the amount of wear of the cleaning blade 52 after durability printing of 300000 sheets and 600000 sheets, occurrence of image defects after durability printing of 600000 sheets, and the driving torque of the photosensitive drum 20. The fabrication method of the photosensitive drums 20 was similar to that for Present Invention 1.

The criteria for evaluating the amount of blade wear were as follows: an instance where the amount of wear in an edge part of the blade was less than 30 μm was evaluated as Good, an instance where it was 30 μm or more but less than 40 μm was evaluated as Fair, and an instance where it was 40 μm or more was evaluated as Poor. The criteria for evaluating image defects were as follows: an instance where reducing the charging bias to below the standard charging bias did not cause an image defect was evaluated as Good, an instance where the standard charging bias did not cause an image defect but a lower-than-the-standard charging bias caused an image defect was evaluated as Fair, and an instance where even the standard charging bias caused an image defect was evaluated as evaluated as Poor. The criteria for evaluating the driving torque were as follows: an instance where the driving torque was below 20 mNm was evaluated as Good, an instance where it was 20 mNm or more but less than 30 mNm was evaluated as Fair, and an instance where it was 30 mNm or more was evaluated as Poor. The results of evaluation of the amount of blade wear, image effects, and the driving torque with each photosensitive drum 20 are, along with surface roughness measurement values, shown in Table 1. The variation of the driving torque of the photosensitive drums 20 is shown in FIG. 17.

TABLE 1

| | Ra [nm] | Rz [μm] | Sm [μm] | Ra/Sm | Rsk | Blade Wear 300000 Sheets | Blade Wear 600000 Sheets | Image Defects | Torque | Overall |
|---|---|---|---|---|---|---|---|---|---|---|
| Present Invention 2 | 96 | 0.98 | 16 | 6.00 | 0.61 | Good | Good | Fair | Good | Good |
| Present Invention 3 | 60 | 0.65 | 14 | 4.29 | 0.54 | Good | Good | Good | Good | Excellent |
| Present Invention 4 | 50 | 0.56 | 15 | 3.33 | 0.35 | Good | Good | Good | Good | Excellent |
| Present Invention 5 | 45 | 0.54 | 16 | 2.81 | 0.20 | Good | Fair | Fair | Fair | Fair |
| Present Invention 6 | 30 | 0.27 | 9 | 3.33 | 0.92 | Good | Good | Good | Good | Excellent |
| Present Invention 7 | 30 | 0.25 | 12 | 2.50 | −0.10 | Good | Fair | Fair | Fair | Fair |
| Present Invention 8 | 24 | 0.20 | 8 | 3.00 | 1.01 | Good | Fair | Good | Good | Good |
| Comparative Example 2 | 108 | 1.24 | 20 | 5.40 | 1.42 | Good | Good | Poor | Good | Poor |
| Comparative Example 3 | 12 | 0.06 | 4 | 3.00 | 0.33 | Poor | Poor | Poor | Poor | Poor |

Figure 17:
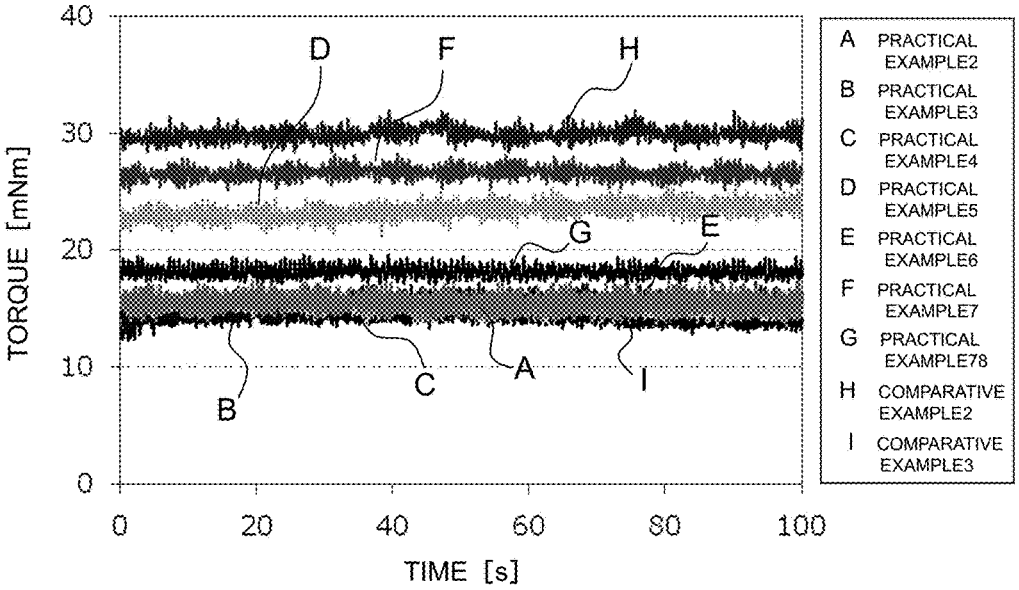
FIG. 17 is a graph showing variation of the driving torque of the photosensitive drum 20 during printing in Practical Example 2.

As will be clear from Table 1 and FIG. 17, with the photosensitive drums 20 of Present Inventions 2 to 8, where the arithmetic average roughness Ra was 20 to 100 nm and the ten-point average roughness Rz was 0.20 to 1.0 μm, the blade ware amount after durability printing of 300000 sheets was less than 30 μm. Moreover, after durability printing of 600000 sheets, applying the standard charging bias did not cause image defects, and the driving torque of the photosensitive drum 20 was less than 30 mNm.

In particular, with Present Inventions 3, 4, and 6, where Ra/Sm is equal to or more than 3 and Rsk equals to or more than 0.3, even after durability printing of 600000 sheets, the blade wear amount was less than 30 μm, and even a lower-than-the-standard charging bias did not cause image defects, and in addition the driving torque of the photosensitive drum 20 was less than 20 mNm.

By contrast, with the photosensitive drum 20 of Comparative Example 2, where the arithmetic average roughness Ra was more than 100 nm and the ten-point average roughness Rz was more than 1.0 μm, after durability printing of 600000 sheets, the blade wear amount was less than 30 μm, and the driving torque of the photosensitive drum 20 was less than 20 mNm, but even applying the standard charging bias caused image defects. This is considered to be because, when the surface irregularities of the photosensitive layer 20*b* at the initial stage of use of the photosensitive drum 20 are too large, scraping-through of additive through concave and convex parts of the photosensitive layer 20*b* occurs, and the charging roller 42 is contaminated with the additive, resulting in uneven electrostatic charging.

With the photosensitive drum 20 of Comparative Example 3, where Ra/Sm=3 and Rsk=0.33 but the arithmetic average roughness Ra was less than 20 nm and the ten-point average roughness Rz was less than 0.2 μm, after durability printing of 300000 sheets, the blade wear amount was as large as 40 μm or more. Also, the driving torque of the photosensitive drum 20 was as large as 30 mNm or more. This is considered to be because, when the surface irregularities on the photosensitive layer 20*b* at the initial stage of use of the photosensitive layer 20*b* are too small, the surface irregularities on the photosensitive layer 20*b* quickly flatten during durability printing, and the contact area between the photosensitive drum 20 and the cleaning blade 52 increases.

INDUSTRIAL APPLICABILITY

The present invention finds application in electrophotographic photosensitive bodies on the surface of which a toner image is formed. By use of the present invention, it is possible to provide an electrophotographic photosensitive body, and an image forming apparatus provided with one, that can suppress image defects for a long period.

The invention claimed is:

1. An electrophotographic photosensitive member, comprising:

a support member; and a photosensitive layer formed on a surface of the support member, wherein at an initial stage of use, a surface of the photosensitive layer has an arithmetic average Ra in a range of 20 nm or more but 100 nm or less, a ten-point average Rz in a range of 0.2 μm or more but 1.0 μm or less, and an average peak-valley interval Sm of 20 μm or less, and at the initial stage of use, the surface of the photosensitive layer has a skewness Rsk of 0.3 or more.

2. The electrophotographic photosensitive member of claim 1, wherein at the initial stage of use, the surface of the photosensitive layer has a ratio Ra/Sm of 3 or more.

3. The electrophotographic photosensitive member of claim 1, wherein the surface of the photosensitive layer has a DUH hardness of 500 kgf/mm$^2$ or more but 1200 kgf/mm$^2$ or less.

4. The electrophotographic photosensitive member of claim 1, wherein the photosensitive layer is formed on an outer circumferential face of the support member, which is cylindrical in shape, and surface irregularities having the arithmetic average Ra, the ten-point average Rz, and the average peak-valley interval Sm are formed in axial and circumferential directions of the support member.

5. The electrophotographic photosensitive member of claim 4, wherein the surface irregularities on the surface of the photosensitive layer are formed irregularly in the axial and circumferential directions of the support member .

6. The electrophotographic photosensitive member of claim 1, wherein the photosensitive layer is formed of amorphous silicon.

7. An image forming apparatus comprising the electrophotographic photosensitive member of claim 1.

* * * * *